US005113756A

United States Patent [19]

Fujii

[11] Patent Number: 5,113,756

[45] Date of Patent: May 19, 1992

[54] PRESS MACHINE

[75] Inventor: Yutaka Fujii, Iwakuni, Japan

[73] Assignee: Teijin Seiki Company, Limited, Osaka, Japan

[21] Appl. No.: 574,769

[22] Filed: Aug. 30, 1990

[30] Foreign Application Priority Data

Sep. 20, 1989 [JP] Japan ..... 1-245757

[51] Int. Cl.[5] ..... B30B 15/14

[52] U.S. Cl. ..... 100/48; 100/53; 100/99; 100/257; 72/21; 72/446; 83/530; 83/640

[58] Field of Search ..... 100/43, 46, 48, 53, 100/257, 291, 292, 99; 72/21, 441, 446; 83/527, 530, 640

[56] References Cited

U.S. PATENT DOCUMENTS

| | | | |
|---|---|---|---|
| 2,185,096 | 12/1939 | Treer | 72/446 |
| 2,603,145 | 7/1952 | Dreis | 100/46 |
| 3,044,389 | 9/1962 | Rexford | 100/48 |
| 3,280,394 | 10/1966 | Clements | 100/257 |
| 3,334,581 | 8/1967 | Bergman | 83/530 |
| 3,367,168 | 2/1968 | McHenry et al. | 762/441 |
| 3,841,140 | 10/1974 | Hryc | 72/441 |
| 4,210,046 | 7/1980 | Pretty | 83/530 |
| 4,621,517 | 11/1986 | Hatanaka et al. | 72/21 |

FOREIGN PATENT DOCUMENTS

| | | | |
|---|---|---|---|
| 892274 | 7/1949 | Fed. Rep. of Germany | 100/53 |
| 1363341 | 4/1963 | France | 83/530 |
| 7440 | 1/1984 | Japan | 72/21 |
| 174299 | 9/1985 | Japan | 100/99 |
| 238499 | 10/1986 | Japan | 100/257 |
| 255298 | 10/1990 | Japan | 100/99 |

*Primary Examiner*—Philip R. Coe
*Assistant Examiner*—Mark Spisich
*Attorney, Agent, or Firm*—Lane, Aitken & McCann

[57] ABSTRACT

A press machine comprising: a slider which reciprocates between its top dead point position and bottom dead point position; a stationary bolster; a position adjusting mechanism for adjusting an up-and-down relative position between the slider and the bolster; a bottom dead point position detecting mechanism for detecting a position of the slider held in the bottom dead point position; a moving body on which the bottom dead point position detecting mechanism is supported and which is movable in the directions in which the slider reciprocates; and a follow-up mechanism connected to the position adjusting mechanism so that the moving body can follow up a position adjustment movement of the slider, the bottom dead point position detecting mechanism being moved so that it can follow up the position adjustment movement of the slider.

8 Claims, 6 Drawing Sheets

PRESS MACHINE

FIELD OF THE INVENTION

The present invention relates to press machines, and more particularly to such machines which have the function of adjusting a so-called "die height" which is the up-and-down relative position between the slider and the bolster.

DESCRIPTION OF THE PRIOR ART

In press machines, the position of the slider in its bottom dead point tends to change due to the fluctuation in the slider strokes and the thermal expansion of the components. Consequently, a so-called "die height", that is, the up-and-down relative position between the slider and the bolster, changes. It is known that the die height change has an adverse effect on final products. It is possible that the die height change resulting from the stroke fluctuation is prevented by increasing the work accuracy and thus making the stroke fluctuation small. Also, it is possible that the die height change resulting from the thermal expansion of the components is prevented by circulating a large number of oils through the press machine and thus restraining the temperature rise to the components. However, in such a case, the circulation of oil and the temperature control require substantial power and are expensive. For this reason, in order to prevent the die height change in consideration of economic aspects, there has been proposed a press machine provided with a position adjusting mechanism for adjusting the up-and-down relative position between the slider and the bolster, that is, the die height.

In such a press machine with a position adjusting mechanism, a bottom dead point position detector for detecting the position of the slider in its bottom dead point is provided to adjust the die height. The bottom dead point position detector is supported on an attachment bracket which is detachably attached on the frame of the press machine by setscrews. The bottom dead point position detector detects the slider position in the bottom dead point from the distance change between the position detector and a detection body fast on the slider. Since it is necessary to detect the position of the bottom dead point in microns, the space between the bottom dead point position detector and the detection body on the slider in the bottom dead point is held within a microscopic distance of about 1 mm.

Also, the position adjusting mechanism is also used for the die height adjustment in exchanging the die for a different high one. In that case, the die height adjustment is made by the reading value of an additional counter instead of the bottom dead point position detector. The adjusting amount of the die height adjustment at that time is normally greater than the space between the bottom dead point position detector and the detection body. For this reason, after the bottom dead point position detector has been moved by loosening the setscrews of the attachment bracket, the die height is adjusted by the manipulation bottom for operating the position adjusting mechanism. After the die height adjustment, the bottom dead point position detector is again attached to a predetermined position.

Furthermore, the die height adjustment is needed also when the press machine is started again, because the temperature of the press machine falls after the stop of the pressing operation. That is, although the slider is held in the top dead point position during the stop of the pressing operation, the slider position in the top dead point changes because of the temperature fall of the components after the stop of the operation. If with that condition the press machine is started, the position of the bottom dead point will change since the stroke of the slider does not change. It is therefore required that a top dead point position detector is provided for detecting the position of the slider in its top dead point, and that, immediately before the pressing operation is started again, the die height adjustment is made in accordance with the detection results of the top dead point position detector by the position adjusting mechanism.

However, in the conventional press machine in which the bottom dead point position detector is fixed to the frame through the attachment bracket, if it is forgotten to loose the setscrews of the attachment bracket and move the bottom dead point position detector when the position adjusting mechanism is operated, the bottom dead point position detector contacts with the detection body and is thus damaged. In addition, since it is necessary to attach the bottom dead point position detector to a predetermined position after the die height adjustment, there was the drawback that the positioning operation is troublesome. Note that, in the case where a top dead point position detector is provided, there is the possibility that the above described drawbacks also occur in the top dead point position detector.

Accordingly, it is an object of the present invention to provide an improved press machine which can eliminate the trouble of the positioning of the bottom dead point position detector after the die height adjustment and prevent the damage to the bottom dead point position detector caused by the error of working process.

SUMMARY OF THE INVENTION

In accordance with an important aspect of the present invention, there is provided a press machine comprising: a slider which reciprocates between its top dead point position and bottom dead point position; a stationary bolster; position adjusting means for adjusting an up-and-down relative position between the slider and the bolster; bottom dead point position detecting means for detecting a position of the slider held in the bottom dead point position; a moving body on which the bottom dead point position detecting means is supported and which is movable in the directions in which the slider reciprocates; and follow-up mean connected to the position adjusting means so that the moving body can follow up a position adjustment movement of the slider, the bottom dead point position detecting means being moved so that it can follow up the position adjustment movement of the slider.

In addition, the bottom dead point position detecting means may be detachably supported on the moving body, and a position at which the bottom dead point position detecting means is attached to the moving body may be changeable.

In addition, the follow-up means may comprise a worm driven by the position adjusting means, a worm wheel meshing with the worm, and a screw shaft extending parallel to the reciprocating direction of the slider and meshing with an internal screw bore formed in the moving body and connected to the worm wheel so as to rotate with the worm wheel.

Furthermore, the press machine may further comprise top dead point position detecting means attached to the moving body for detecting a position of the slider held in the top dead point position.

In the present invention, if the up-and-down relative position between the slider and the bolster is adjusted by the position adjusting means, the bottom dead point position means, together with the moving body, are then moved by the follow-up means, so that the bottom dead point position means follows up the position adjustment movement of the slider.

Consequently, when a die height adjustment is made in exchanging dies, it is not necessary to move the bottom dead point position means. As a result, since it is not necessary to set the bottom dead point position detector to a predetermined position after the die height adjustment is complete, the trouble caused by the position adjustment can be eliminated, and the damage to the bottom dead point position detector resulting from the error of working processes can be prevented.

In addition, the bottom dead point position detecting means may be detachably supported on the moving body, and a position at which the bottom dead point position detecting means is attached to the moving body may be changeable. Therefore, the present invention can be used even in the case where the stroke of the slider is required to be changed when the dies are exchanged.

Furthermore, the follow-up means may comprise a worm driven by the position adjusting means, a worm wheel meshing with the worm, and a screw shaft extending parallel to the reciprocating direction of the slider and meshing with an internal screw bore formed in the moving body and connected to the worm wheel so as to rotate with the worm wheel. Consequently, the structure of the follow-up mechanism can be made simple, thereby reducing the cost of the press machine.

In addition, even if the top dead point position means is attached to the moving body, the present invention can have the above described advantages, as in the case of the bottom dead point position means.

BRIEF DESCRIPTION OF THE DRAWINGS

The above and other objects and advantages will become apparent from the following detailed description when read in conjunction with the accompanying drawings wherein.

DESCRIPTION OF THE PREFERRED EMBODIMENTS

A preferred embodiment of a press machine according to the present invention will hereinafter be described in detail in conjunction with the accompanying drawings.

Figure 1:
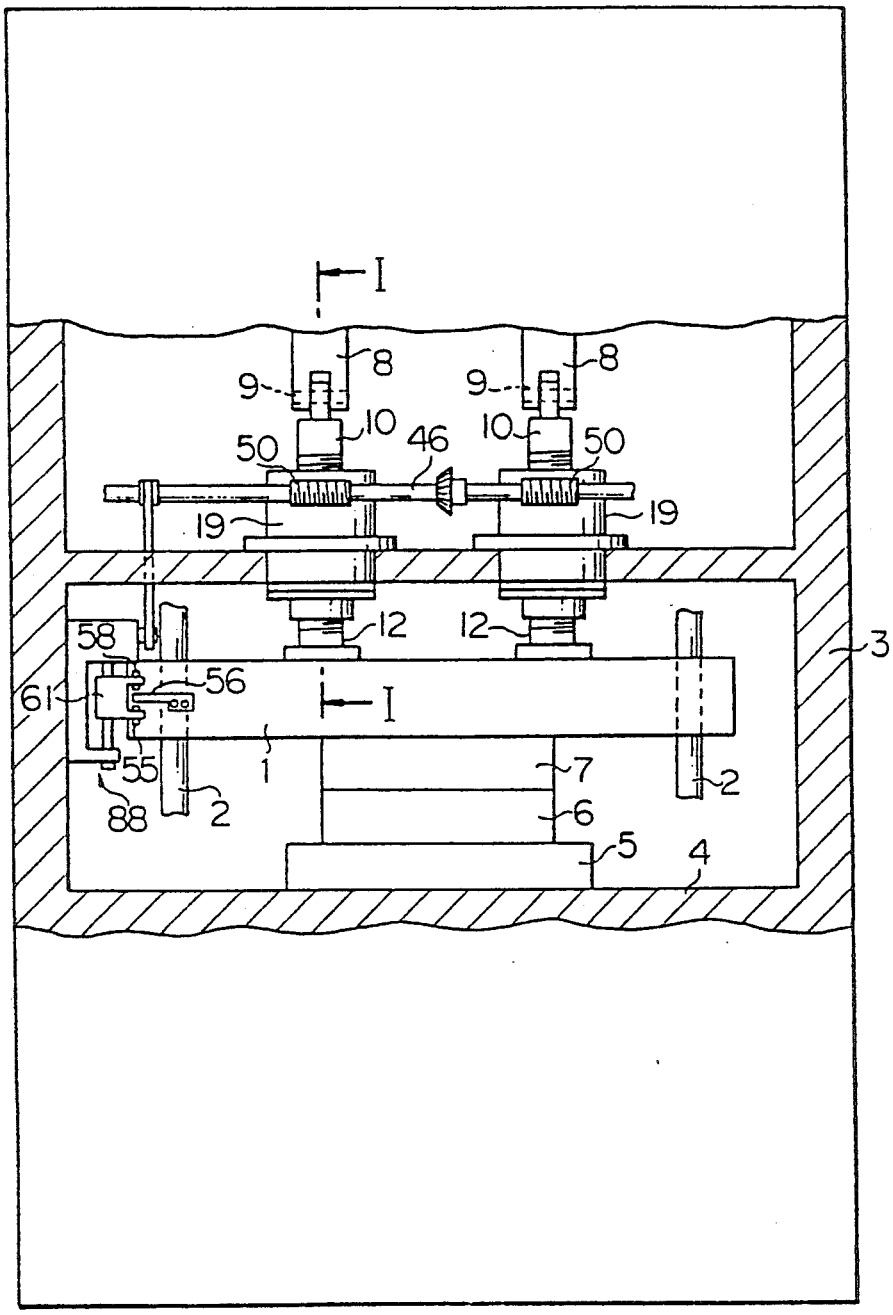
FIG. 1 is a fragmentary elevational view of the press machine according to the present invention.
Figure 2:
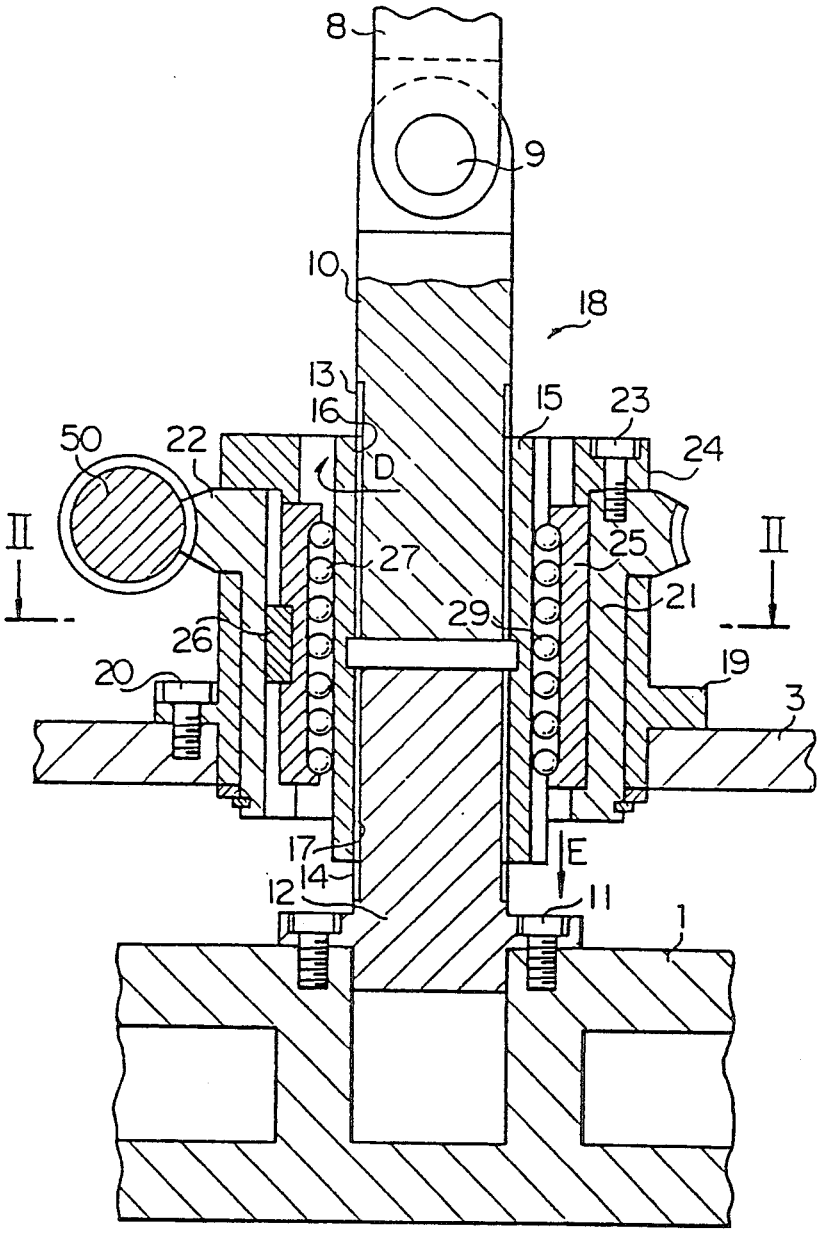
FIG. 2 is a cross sectional view taken substantially along the line I—I of FIG. 1.
Figure 3:
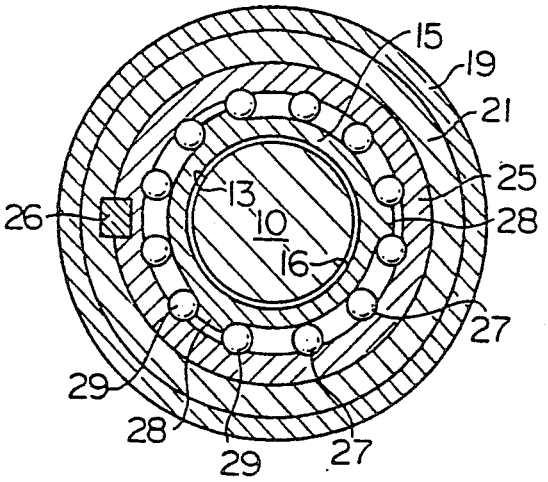
FIG. 3 is a cross sectional view taken substantially along the line II—II of FIG. 2.

In FIGS. 1 through 6, reference numeral 1 denotes a slider which is reciprocated between its top dead point position and bottom dead point position by cranks, links and cams (not shown). The reciprocating motion of the slider 1 is guided by a guide rod 2, which is inserted through the slider 1 and attached to a frame 3. A bolster 5 is fixedly mounted on the bed surface 4 of the frame 3 located immediately under the slider 1, and has a lower die 6 detachably mounted thereon. An upper die 7 is detachably mounted on the lower surface of the slider 1. The upper and lower dies 6 and 7 are driven to compress and shape a workpiece by the reciprocating motion of the slider 1. Reference numerals 8 and 8 are a pair of plungers which are connected to cranks (not shown). The lower ends of the plungers 8 are connected through pins 9 with the upper ends of upper screw rods 10, respectively. As shown in FIGS. 1 and 2, lower screw rods 12 are fixedly mounted on the upper surface of the slider 1 immediately under the upper screw rods 10 by a plurality of bolts 11. That is, the lower screw rods 12 are arranged coaxially with the upper screw rods 10. As shown in FIG. 2, the upper and lower screw rods 10 and 12 are respectively formed at the outer surfaces thereof with inverse screws. In the embodiment of FIG. 2, the upper screw rods 10 are each formed at their outer surface with a right-handed screw 13, and the lower screw rods 12 are each formed at their outer surface with a left-handed screw 14. Reference numeral 15 is a cylindrical inner race, which is formed at its upper inner surface with a right-handed screw 16 and at its lower inner surface with a left-handed screw 17. The upper screw rod 10 is inserted in the upper portion of the inner race 15 so that the right-handed screws 13 and 16 mesh with each other, and the lower screw rod 12 is inserted in the lower portion of the inner race 15 so that the left-handed screws 14 and 17 mesh with each other. As a result, the upper and lower screw rods 10 and 12 are connected through the inner race 15 with each other. The upper screw rod 10, lower screw rod 12 and inner race 15 as a whole constitute an adjusting screw shaft 18. Reference numerals 19 and 19 are a pair of generally cylindrical cases, which are fixedly mounted in the frame 3 by a plurality of bolts 20. Each case 19 surrounds the inner race 15. Within the cases 19 are inserted rotating bodies 21, which are each formed at their upper end portion integrally with a worm wheel 22 with its lower face received on the upper end face of the case 19. A cover 24 is fixedly mounted on the upper end face of the worm wheel 22 by a bolt 23. Reference numeral 25 is an outer race which is inserted within the rotating body 21, and the outer race 25 is attached through a key 26 to the rotating body 21 so that the outer race 25 can rotate with the rotating body 21. Between the inner and outer races 15 and 25 there are interposed a plurality of balls 27 which are mounted in part in the outer race 25. The balls 27 allow the inner race 15 to axially move within the outer race 25. As shown in FIG. 3, the inner race 15 is formed at its outer surface with a plurality of transmission projections 28 axially extending and spaced apart equidistantly in the circumferential direction of the inner race 15. Also, a plurality of transmission balls 29, which are mounted in part in the outer race 25, contact with the opposite side faces of the transmission projections 28. Consequently, the transmission balls 29 transmit the rotations of both directions of the rotating body 21 and outer race 25 accurately to the inner race 15 to rotate the inner race 15.

Figure 4:
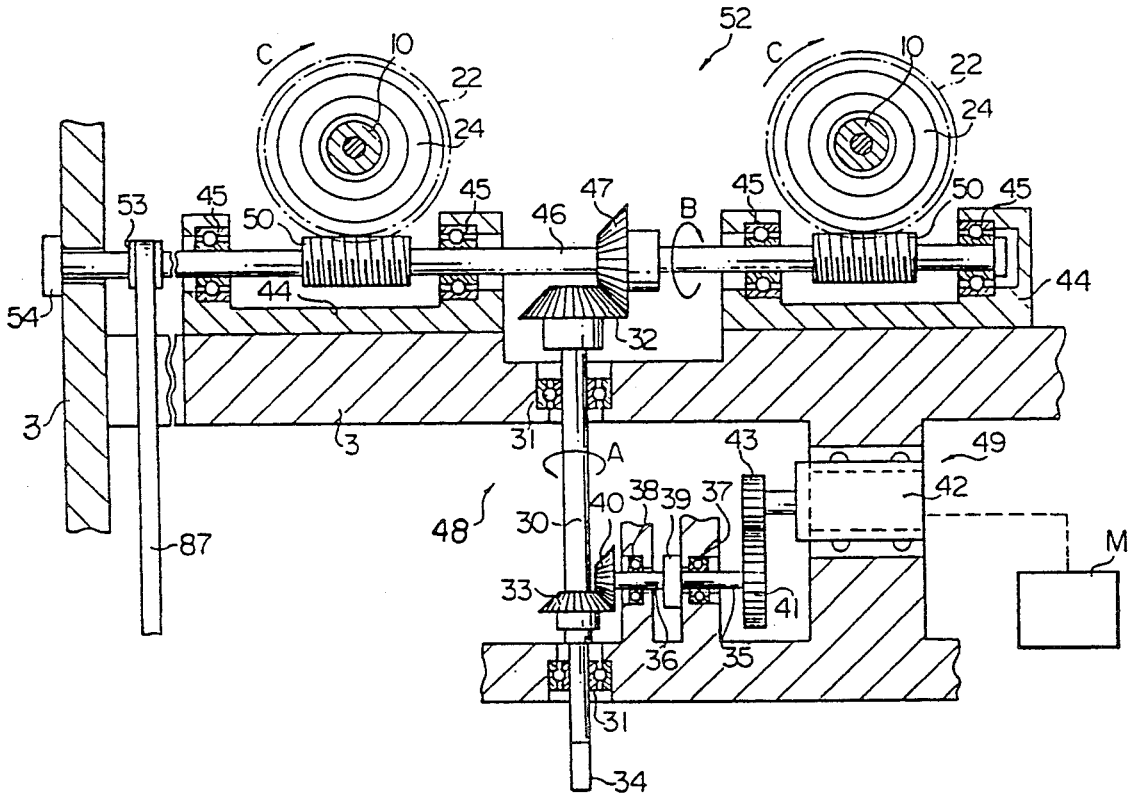
FIG. 4 is a cross sectional view of the position adjusting mechanism.

As shown in FIG. 4, reference numeral 30 is a transmission shaft which is rotatably supported through a bearing 31 on the frame 3. The transmission shaft 30 has a bevel gear 32 fixedly mounted on its one end and a bevel gear 33 fixedly mounted on its central portion. Also, the transmission shaft 30 is provided at the other end with a handle manipulation portion 34 on which a handle (not shown) is mounted. As shown in FIG. 4, the frame 3 supports an input shaft 35 and an output shaft 36 through bearings 37 and 38, respectively. The input and output shafts 35 and 36 are axially aligned with each other and are perpendicular to the transmission shaft 30. Between the input and output shafts 35 and 36 there is interposed a clutch 39 which has its input end coupled to the input shaft 35 and its output end coupled to the output shaft 36. Between the input and output ends of the clutch 39 there are provided a friction plate (not shown) and an electromagnetic device (not shown) to connect and disconnect the input and output shafts 35 and 36 by operation of the clutch 39. A bevel gear 40 is fixedly mounted on the end of the output shaft 36 opposite the clutch 39, and meshes with the bevel gear 33 on the transmission shaft 30. A spur gear 41 is fixedly mounted on the end of the input shaft 35 opposite the clutch 39, and meshes with a spur gear 43 fixedly mounted on the drive shaft of a motor 42, which is fixedly mounted on the frame 3. The motor 42 is connected to a control part M and driven by the control part M. Two bearing cases 44 are mounted on the frame 3 adjacent the cases 19, and have a horizontal worm shaft 46 rotatably supported thereon through bearings 45. The horizontal worm shaft 46 extends perpendicular to both the upper screw rods 10 and the transmission shaft 30. The worm shaft 46 is provided at its central portion with a bevel gear 47 meshing with the bevel gear 32 of the transmission shaft 30. The output shaft 36, transmission shaft 30 and horizontal worm shaft 46 as a whole constitute a drive shaft 48. The input shaft 35, spur gears 41, 43, and motor 42 as a whole constitute a motor driving part 49. The horizontal worm shaft 46 has fixedly mounted thereon a pair of worms 00 respectively meshing with the worm wheels 22. The worms 50 rotate with the drive shaft 48 by rotation of the drive shaft 48. The drive shaft 48 is rotated by the manual manipulation of the handle manipulation portion 34 of the transmission shaft 30 or by the motor drive of the motor driving part 49. It is necessary to switch the clutch 39, depending on the manual manipulation or motor drive. The rotations of the worms 50 are reduced with a high ratio by the worm wheels 22 meshing with the worms 50, and then transmitted through the outer race 22 and transmission balls 29 to the inner race 15 of the adjusting screw shaft 18. This causes the lower screw rods 12 and accordingly the slider 1 to go up and down. Consequently, the up-and-down relative position between the slider 1 and the bolster 5, that is, the "die height" is adjusted. If, for example, the transmission shaft 30 is rotated in the direction A of FIG. 4, then the worm shaft 46 rotates in the direction B, the worm wheels 22 rotate in the direction C, the inner races 15 rotate in the direction D of FIG. 2 and move down in the direction E, and the slider 1 moves down in the direction E. 15 revolutions of the horizontal worm gear 46 cause the slider 1 to move 1.5 mm.

Thus, the above described drive shaft 48, worms 50, worm wheels 22, outer races 25, transmission balls 29, adjusting screw shafts 18 and motor driving part 49 as a whole constitute a position adjusting mechanism 52 which adjusts the up-and-down relative position between the slider 1 and the bolster 5, that is, the "die height".

Also, the horizontal worm shaft 46 extends through the bearing case 45 and the frame 3, and has its one end connected with a counter 54 which indicates the amount of rotation of the worm shaft 46 (amount of die height). A pulley 53 is fixedly mounted on the worm shaft 46 between the bearing case 45 and the counter 54.

Figure 6:
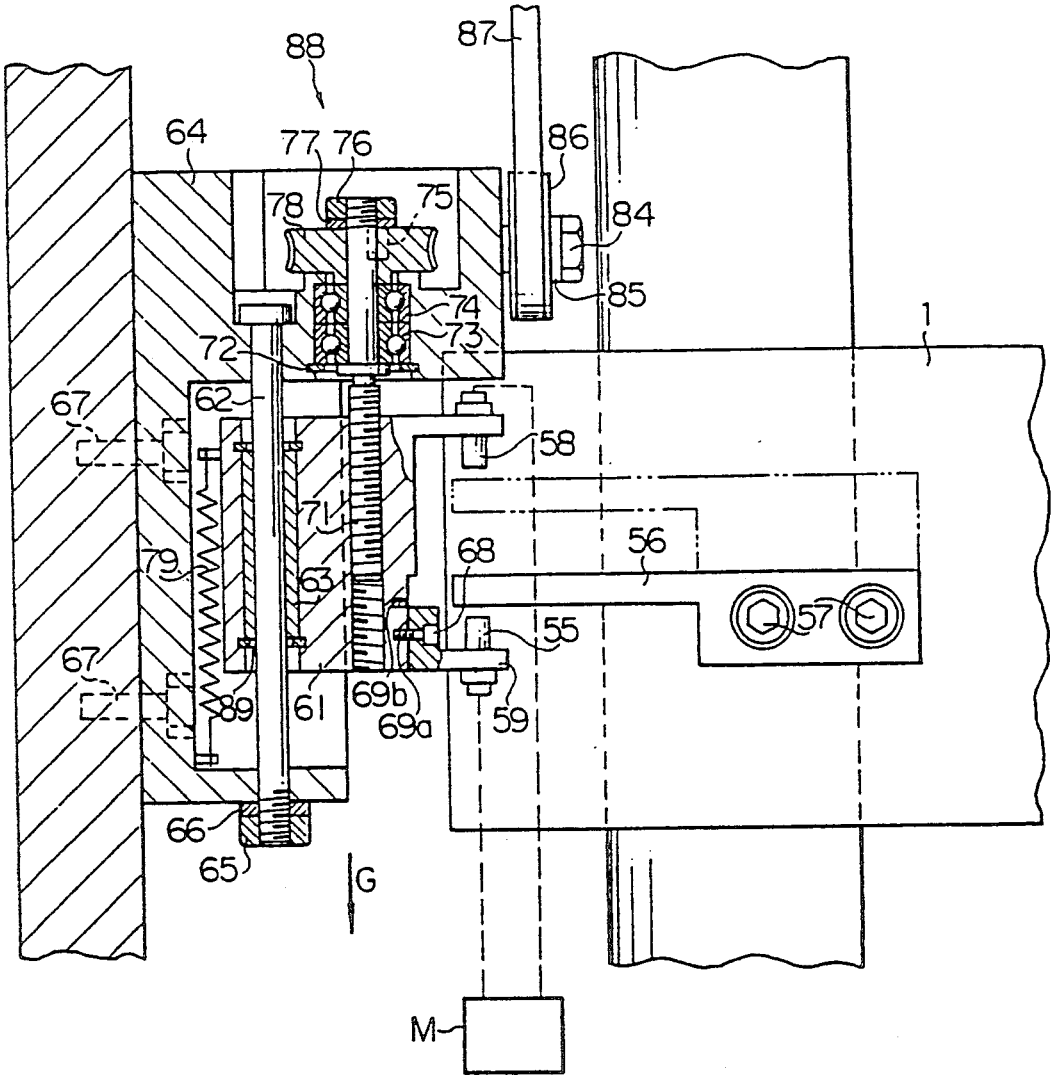
FIG. 6 is a cross sectional view taken substantially along the line III—III of FIG. 5.

As shown in FIGS. 1 and 6, reference numeral 55 denotes a bottom dead point position detector 55, which is a displacement sensor of the eddy current type which detects displacement of several microns and outputs an analog signal of several mVs. Reference numeral 56 is a detection body fixed on the slider 1 by bolts 57. The bottom dead point position detector 55 is provided at a position spaced apart about 1 mm from the detection body 56 when the slider 1 is in its bottom dead point. The bottom dead point position detector 55 detects the position of the slider 1 held in the bottom dead point and then outputs an electric signal proportional to the detected displacement to the control part M. Reference numeral 58 is a top dead point position detector which is the same displacement sensor as the bottom dead point position detector 55. The top dead point position detector 58 is provided at a position spaced apart about 1 mm from the detection body 56 when the slider 1 is in its top dead point. The top dead point position detector 58 detects the position of the slider 1 held in the top dead point and then outputs an electric signal proportional to the detected displacement to the control part M.

Note that the control part M has a function of automatically adjusting the "die height" during the operation or stop of the press machine by driving the motor driving part 49 in response to the electric signals from the bottom dead point position detector 55 and top dead point position detector 58.

That is, during the pressing operation, the up-and-down relative position between the slider 1 and the bolster 5 changes due to the thermal expansion of the components and therefore the die height shifts from an appropriate value. At this time, the control part M detects the direction and amount of displacement of the up-and-down relative position with the electric signal from the bottom dead point position detector 55. Based upon the detected result, the control part M drives the motor driving part 49, thereby adjusting the die height to an appropriate value. This adjustment of the die height is made every several strokes of the pressing operation.

In addition, during the stop of the pressing operation in which the slider 1 is in its top dead position, the up-and-down relative position between the slider 1 and the bolster 5 changes due to the temperature fall after the stop of the pressing operation and therefore the die height shifts from an appropriate value. At this time, the control part M detects the direction and amount of displacement of the up-and-down relative position with the electric signal from the top dead point position detector 58. Based upon the detected result, the control part M drives the motor driving part 49, thereby adjusting the die height to an appropriate value. This adjustment of the die height is made immediately before the pressing operation is started again. Note that when the die height adjustment is made, the input and output shafts 35 and 36 are coupled together by the clutch 39. In addition to the above described die height adjustment required during the pressing operation and the stop of operation, the dies height adjustment is also required in exchanging dies. In this adjustment in exchanging die, the handle manipulation portion 39 and a manipulation bottom (not shown) provided in the control part M are used. The drive of the motor driving part 49 is also controlled by an ON and OFF of the manipulation bottom of the control part M. The processes of this die height adjustment will be described later.

Figure 5:
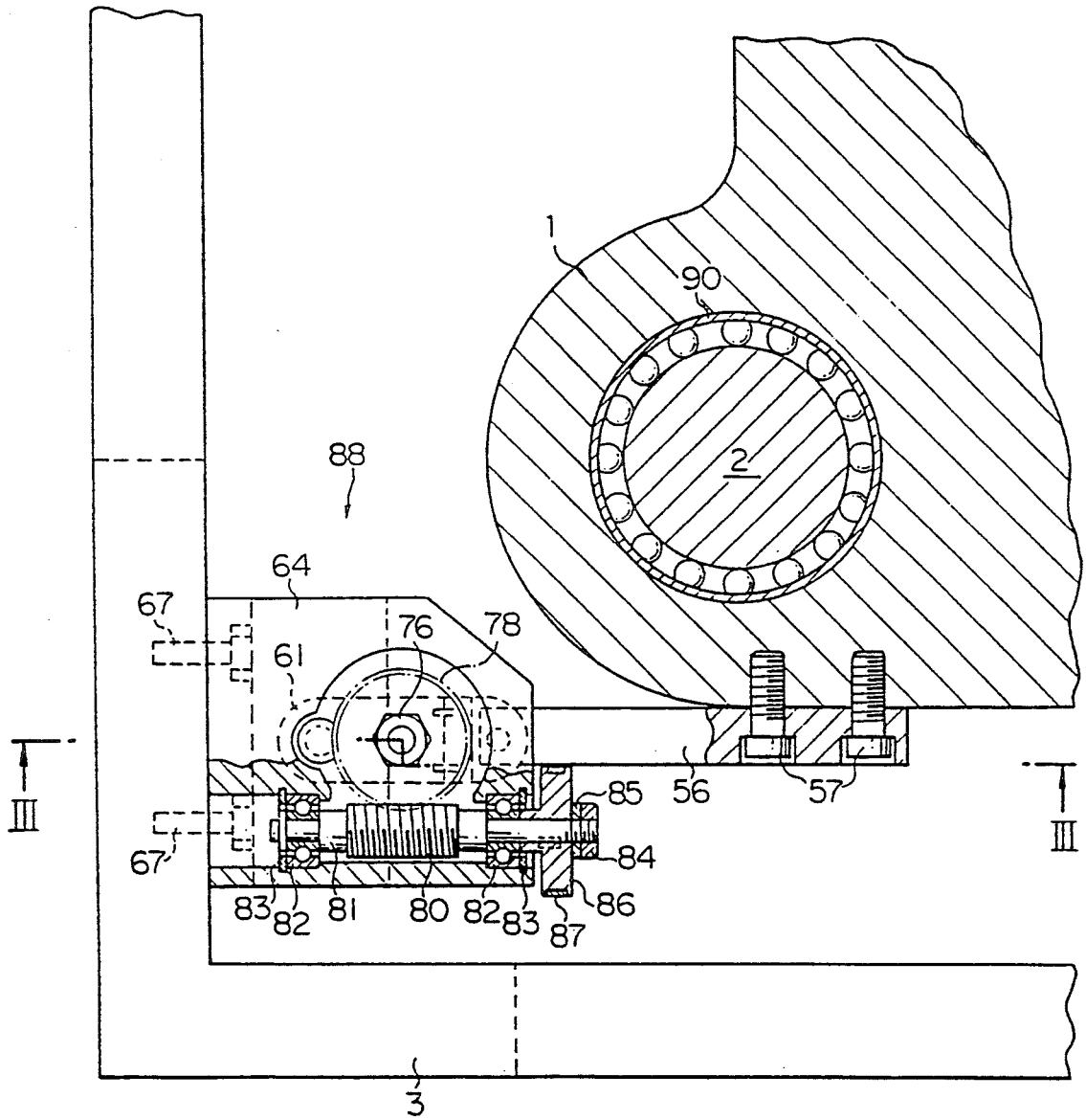
FIG. 5 is an enlarged view of the follow-up mechanism.

As shown in FIG. 6, the bottom dead point position detector 55 is supported through an attachment member 59 on a moving body 61. The moving body 61 is disposed so that it can move in the directions in which the slider 1 reciprocates. That is, a guide rod 62 extending in the up and down directions in which the slider 1 reciprocates is inserted in the moving body 61 through a thrust bush 63, so that the moving body 61 can move along the guide rod 62 in the directions in which the slider 1 reciprocates. The guide rod 62 has a threaded portion at its lower end, and is fixed to a case 64 by a nut 65 meshing with the threaded portion. The case 64 is fixedly mounted on the frame 3 by a plurality of bolts 67. Also, the attachment member 59 is detachably mounted on the moving body 61 by a bolt 68, and the moving body 61 is formed with screw bores 69*a* and 69*b* into which the bolt 68 can be screwed. The screw bores 69*a* and 69*b* are spaced apart in the up and down directions so that the mounting position of the bottom dead point position detector 55 on the moving body 61 can be changed. A screw shaft 71 extending parallel to the reciprocating direction of the slider 1 meshes with the internal screw bore formed in the moving body 61, and is supported on the case 64 through bearings 73 and 74. The screw shaft 71 has a worm wheel 78 mounted on its one end through a key 75 and a nut 76 so that the shaft 71 can rotate with the worm wheel 78. A spring 79 is interposed between the moving body 61 and the case 64 to prevent the backlash between the screw shaft 71 and the moving body 61. As shown in FIG. 5, the worm wheel 78 connected with the moving body 61 meshes with a worm 80 fast on a worm shaft 81. The worm shaft 81 is freely rotatably supported on the case 64 through bearings 82 and 82. A driven pulley 86 is fixed on one end of the worm shaft 81 by a nut 84. As shown in FIGS. 1, 4 and 5, the driven pulley 86 fast on the worm shaft 81 and the drive pulley 53 fast on the worm shaft 46 are connected together through an endless belt 87 with teeth so that the rotation of the worm shaft 46 can be transmitted to the worm shaft 81. The rotational speed of the worm shaft 46 is the same as that of the worm shaft 81, and the speed reduction ratio between the worm 80 and the worm wheel 78 is 1/15. The screw portion of the screw shaft 71 meshing with the moving body 61 is a right-handed screw with a pitch of 1.5 mm, and one turn of the screw shaft 71 causes the moving body 61 to move 1.5 mm in the directions in which the slider 1 reciprocates. If, for example, the worm shaft 46 makes 15 revolutions in the direction B of FIG. 4, the moving body 61 will move 1.5 mm in the direction G of FIG. 6. The amount and direction of the movement of the moving body 61 are the same as those of the slider 1 when the worm shaft 46 makes 15 revolutions in the direction B of FIG. 4. The same is true of the case that the worms shaft 46 rotates in the reverse direction. Thus, the above described guide rod 62, thrust bush 63, case 64, screw rod 71, worm wheel 78, worm 80, worm shaft 81 and driven pulley 86 as a whole constitute a follow-up mechanism 88 which is connected to the position adjusting mechanism 52 so that the moving body 61 can follow the movement of position adjustment of the slider 1.

The processes of the die height adjustment at the time the dies are exchanged will hereinafter be described.

When the upper and lower dies 7 and 6 are exchanged for dies of different height, it will be necessary to adjust the die height. Since an appropriate height has been known from the dimensions of the upper and lower dies 7 and 6, the slider 1 is moved in the proximity of an appropriate die height by driving the motor driving part 49 with the manipulation bottom of the control part M, while confirming the indication of the counter 54. The slider 1 is further moved by driving the drive shaft 48 by the manual manipulation of the hand manipulation part 34 of the transmission shaft 30, and is stopped at the position of the die height corresponding to the dies. The amount of the die height at that time is indicated in the counter 54, and the die height adjustment is complete. Note that, during the die height adjustment, the clutch 39 is operated in accordance with a changeover of the motor driving part 49 to the handle manipulation portion 34 or a changeover of the handle manipulation portion 34 to the motor driving part 49. In addition, the die height adjustment operation described above may also be made only by the manual manipulation of the handle manipulation portion 34.

When in the above described die height adjustment operation the slider 1 is moved, the moving body 61 is driven by the drive shaft 48 and moves the same amount as the movement of the slider 1 in the same direction, thereby following up the movement of the slider 1. For this reason, even if the slider 1 were moved in what manner, the relative positions between the bottom dead point position detector 55 and the detection body 56 and between the top dead point position detector 58 and the detection body 56 would not change. Consequently, the detection body 56 on the slider 1 will not contact with the bottom dead point position detector 55 and the top dead point position detector 58, and therefore, it will not be necessary to move the bottom dead point position detector 55 and the top dead point position detector 58 prior to the die height adjustment operation.

Therefore, damage of the bottom dead point position detector 55 and the top dead point position detector 58 resulting from the error of working processes such that the moving operation of the bottom dead point position detector 55 and the top dead point position detector 58 prior to the die height adjustment is forgotten, can be prevented. In addition, since it is not necessary to set the bottom dead point position detector 55 and the top dead point position detector 58 to a predetermined position after the die height adjustment is complete, the trouble caused by the postion adjustment can be eliminated.

In addition, in the embodiment described above, the bottom dead point position detector 55 is detachable with respect to the moving body 61. The attachment member 59 supporting the detector 55 can be attached to the moving body 61 by meshing the attachment bolt 68 with the screw bore 69*a*, and the attachment member 59 can also be attached to the moving body 61 by meshing the attachment bolt 68 with the screw bore 69*b*. For example, in the case of the attachment member 59 attached in the up side, the stroke of the slider 1 is 30 mm. In the case of the attachment member 59 attached in the down side, the stroke of the slider 1 is 40 mm. Therefore, the present invention can be used even in the case where the stroke of the slider 1 is required to be changed when the dies are exchanged. The stroke change of the slider 1 can be made by adjusting the amount of eccentric of the crank.

Furthermore, since in the embodiment of the present invention the follow-up mechanism 88 comprises the worm 80, the worm wheel 78 and the screw shaft 71, the structure of the follow-up mechanism 88 can be made simple, thereby reducing the cost of the press machine.

Note that reference numerals 66, 77 and 85 (FIG. 6) are washers for the prevention of looseness of nuts, and 72 (FIG. 6) and 83 (FIG. 5) are stop rings. Reference numeral 89 (FIG. 6) denotes a stop ring for preventing the thrust bush 63 from axially moving with respect to the moving body 61, and reference numeral 90 (FIG. 5) denotes a bearing interposed between the slider 1 and the guide rod 2.

In addition, instead of the thrust bush 63, a rolling bearing may be used between the moving body 61 and the guide rod 62. Also, the moving body and the guide rod 62 may be connected together by a ball spline engagement.

Furthermore, the structure of the follow-up mechanism 88 is not limited to the embodiment of the present invention, but variations and modifications may be made.

What I claim is:

1. A mechanical press machine comprising:

a slider;

means to reciprocate said slider between its top dead point position and bottom dead point position;

a stationary bolster;

position adjusting means for moving said slider and adjusting an up-and-down relative position between said slider and said bolster;

bottom dead point position detecting means for detecting a position of said slider held in the bottom dead point position;

a moving body on which said bottom dead point position detecting means is supported and which is movable in the directions in which said slider reciprocates; and follow-up means connected to said position adjusting means for moving said moving body by the same amount as movement of said slider and in the same direction as that of said slider to follow a position adjustment movement of said slider whenever said slider is moved by said position adjusting means, said bottom dead point position detecting means being moved to follow said position adjustment movement of said slider in such a manner that a relative position between said bottom dead point position detecting means and said slider does not change when said up-and-down relative position is adjusted.

2. A press machine as set forth in claim 1, in which said bottom dead point position detecting means is detachably supported on said moving body, and a position at which said bottom dead point position detecting means is attached to said moving body is changeable.

3. A press machine as set forth in claim 2, in which said follow-up means comprises a worm driven by said position adjusting means, a worm wheel meshing with said worm, and a screw shaft extending parallel to the reciprocating direction of said slider and meshing with an internal screw bore formed in said moving body and connected to said worm wheel so as to rotate with said worm wheel.

4. A press machine as set forth in claim 3, which further comprises top dead point position detecting means attached to said moving body for detecting a position of said slider held in the top dead point position.

5. A press machine as set forth in claim 2, which further comprises top dead point position detecting means attached to said moving body for detecting a position of said slider held in the top dead point position.

6. A press machine as set forth in claim 1, in which said follow-up means comprises a worm driven by said position adjusting means, a worm wheel meshing with said worm, and a screw shaft extending parallel to the reciprocating direction of said slider and meshing with an internal screw bore formed in said moving body and connected to said worm wheel so as to rotate with said worm wheel.

7. A press machine as set forth in claim 6, which further comprises top dead point position detecting means attached to said moving body for detecting a position of said slider held in the top dead point position.

8. A press machine as set forth in claim 1, which further comprises top dead point position detecting means attached to said moving body for detecting a position of said slider held in the top dead point position.

* * * * *